US006741216B2

(12) United States Patent
Inasawa et al.

(10) Patent No.: US 6,741,216 B2
(45) Date of Patent: May 25, 2004

(54) REFLECTOR ANTENNA

(75) Inventors: Yoshio Inasawa, Tokyo (JP); Izuru Naito, Tokyo (JP); Shigeru Makino, Tokyo (JP); Naofumi Yoneda, Tokyo (JP); Moriyasu Miyazaki, Tokyo (JP); Yoshihiko Konishi, Tokyo (JP); Shuji Urasaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/275,064

(22) PCT Filed: Feb. 28, 2002

(86) PCT No.: PCT/JP02/01863

§ 371 (c)(1),
(2), (4) Date: Dec. 19, 2002

(87) PCT Pub. No.: WO02/071540

PCT Pub. Date: Sep. 12, 2002

(65) Prior Publication Data

US 2003/0151558 A1 Aug. 14, 2003

(30) Foreign Application Priority Data

Mar. 2, 2001 (JP) ..... 2001-058811
Jul. 18, 2001 (WO) ..... PCT/JP01/06236

(51) Int. Cl.[7] ..... H01Q 3/00; H01Q 19/18; H01Q 19/14

(52) U.S. Cl. ..... 343/754; 343/781 P; 343/781 CA

(58) Field of Search ..... 343/754, 731 P, 343/781 P, 704, 761, 781 CA, 837, 839, 840

(56) References Cited

U.S. PATENT DOCUMENTS 4,044,361 A * 8/1977 Yokoi et al. ..... 343/754
4,186,402 A * 1/1980 Mizusawa et al. .... 343/781 CA
4,195,302 A * 3/1980 Leupelt ..... 343/704
6,043,788 A * 3/2000 Seavey ..... 343/781 CA
6,243,047 B1 * 6/2001 Brown ..... 343/781 CA
6,535,177 B1 * 3/2003 Dhellemmes et al. ..... 343/882

FOREIGN PATENT DOCUMENTS

JP 54-067743 A 5/1979
JP 62-140465 U 9/1987
JP 1-235402 A 9/1989

OTHER PUBLICATIONS

Wakana, et al. Proceedings of ISAP2000. Fukuoka, Japan, pp. 497–500.

Aoki, et al. IEE Proc.–Microw. Antennas Propag., vol. 146, No. 1, Feb. 1999.

* cited by examiner

*Primary Examiner*—James Clinger
*Assistant Examiner*—Chuc Tran
(74) *Attorney, Agent, or Firm*—Birch, Stewart, Kolasch & Birch, LLP

(57) ABSTRACT

In order to provide a reflector antenna apparatus which can be installed within a small space, which has adequate practicality, and which can perform scanning by pivoting about two axes which are perpendicular to each other, in a reflector antenna apparatus having a Cassegrain reflector and a rotating mechanism which rotates the reflector about an azimuth axis and an elevation axis, a reflector with a substantially rectangular aperture has its elevation axis passing through substantially the central portion of the height dimension of the reflector, and reflector surface adjustment is carried out such that substantially all of the electromagnetic waves which are supplied are received and reflected, whereby the antenna height does not become large when the reflector rotates about the elevation axis. The reflector may be an array of a plurality of reflector elements.

9 Claims, 7 Drawing Sheets

REFLECTOR ANTENNA

This application is the national phase under 35 U.S.C. §371 of PC International Application No. PC/JP02/01863 which has an International filing date of Feb. 28, 2002, which designated the United States of America.

1. Technical Field

This invention relates to a reflector antenna apparatus, and in particular it relates to a reflector antenna apparatus which can perform scanning by pivoting about two axes which are perpendicular to each other.

2. Background Art

An example of a reflector antenna apparatus which can perform scanning by pivoting about two axes which are perpendicular to each other such as an azimuth axis and an elevation axis is that described, for example, in "Proceedings of ISAP2000", pages 497–500, Japan, by H. Wakana et al. That reflector antenna apparatus is a normal axially symmetric Cassegrain antenna in which the reflector has a subreflector which receives irradiation of electromagnetic waves from a radiator and a main reflector which reflects electromagnetic waves which are reflected from the subreflector and directs them at a target. Not only the height dimensions in the direction of the azimuth axis of the reflector antenna apparatus but also the lengthwise dimensions in the direction of the elevation axis and the widthwise dimensions in the direction perpendicular thereto are large. In addition, the central axis of elevation rotation does not pass through the reflector but passes through a location spaced from the reflector, so if the direction (angle) of the reflector is changed, its position necessarily changes, so it is necessary to provide a large operating space for the reflector of the antenna apparatus, and a large space was necessary for installing the reflector apparatus.

When it is required to install a reflector antenna apparatus in a limited, relatively small space such as when mounting one on an aircraft, a conventional reflector antenna apparatus could not be employed because, as described above, it has a large reflector operating region. It has also been proposed to arrange an array of small antenna elements in a fixed location and decrease height dimensions and to perform scanning by electrically controlling the directionality of the antenna elements, but a control apparatus for electrically controlling such an antenna apparatus becomes extremely expensive, so that proposal has almost no practicality.

Accordingly, an object of this invention is to provide a reflector antenna apparatus which can be installed in a small space, which has sufficient practicality, and which can perform scanning by pivoting about two axes which are perpendicular with respect to each other.

DISCLOSURE OF THE INVENTION

According to the present invention, means for solving the above-described problems are as follows.

(1) A reflector antenna apparatus having a reflector and a rotating mechanism which rotates the reflector about an azimuth axis and an elevation axis, characterized in that the elevation axis passes through a location at substantially the center of the reflector in the direction of the azimuth axis and through substantially the center of the reflector in the direction perpendicular to the elevation axis, and the reflector has a substantially rectangular aperture which is elongated in the direction of the elevation axis, and the reflector has its reflector surface adjusted so as to receive and reflect substantially all of the supplied electromagnetic waves, whereby the antenna height does not become large when the reflector rotates about the elevation axis.

(2) The reflector may have a subreflector which receives electromagnetic waves irradiated by a radiator and a main reflector which reflects electromagnetic waves which are reflected from the subreflector and directs them towards a target.

(3) A portion of a current supply apparatus which rotates at the same time as the reflector antenna may be included in the reflector so that the antenna height does not become large.

(4) The reflector may be a reflector array having a plurality of reflector elements which are arranged in alignment with the elevation axis.

(5) Each of the reflector antennas of the main reflector has a substantially rectangular aperture, and reflector surface adjustment may be carried out so as to form a reflector antenna in which when each reflector antenna is viewed in the direction of the reflector axis, the aperture is rectangular and the electromagnetic field distribution in the aperture is nearly uniform so as to suppress grating lobes.

(6) It is one in which the reflector surface is set so that the radiator is parallel to the azimuth rotational surface, and the center of the central axis of the reflector is aligned with the elevation axis.

(7) It is one in which the reflector surface is set so that the subreflector is not blocked as viewed from the reflector axis.

(8) The reflector antenna is a Cassegrain antenna.

(9) The reflector antenna is a Gregorian antenna.

BEST MODE FOR CARRYING OUT THE INVENTION

Embodiment 1

Figure 1:
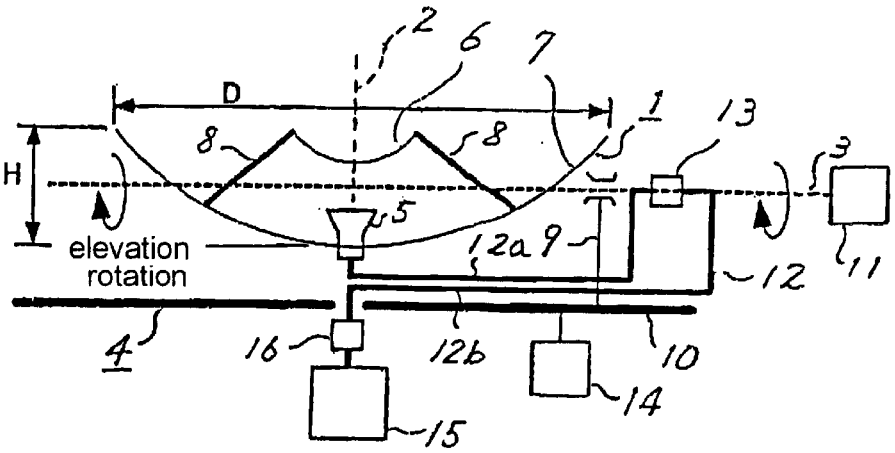
FIG. 1 is a schematic side view showing a reflector antenna apparatus of an embodiment of this invention.
Figure 2:
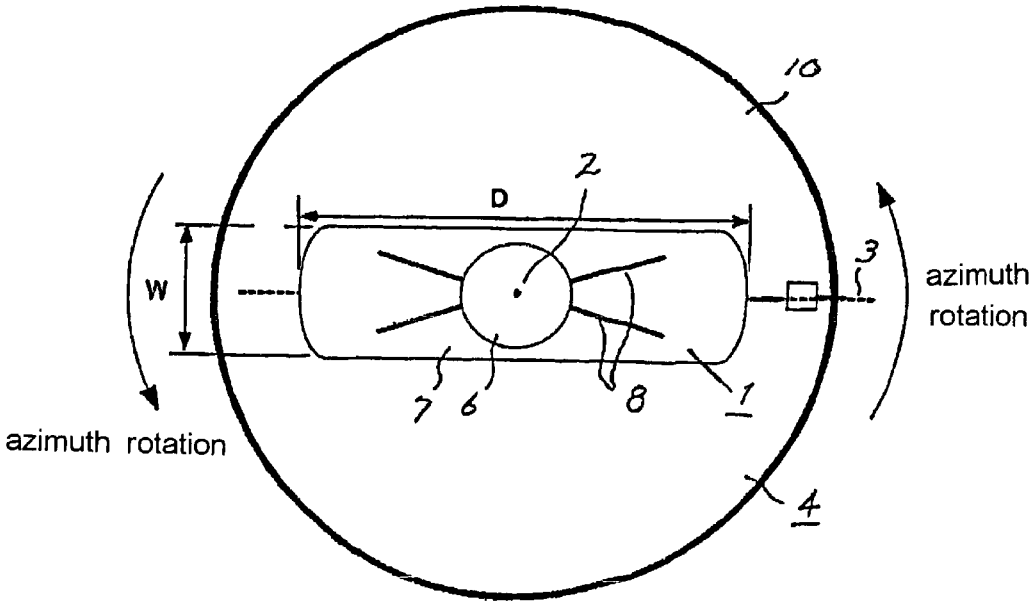
FIG. 2 is a schematic plan view showing the reflector antenna apparatus of FIG. 1.

Embodiment 1 of a reflector antenna apparatus according to this invention is shown in FIG. 1 and FIG. 2. In these figures, a reflector antenna apparatus has a reflector 1 and a rotating mechanism 4 which rotates the reflector 1 about an azimuth axis 2 and an elevation axis 3. The reflector 1 has a subreflector 6 which receives irradiation of electromagnetic waves from a radiator 5 which generates electromagnetic waves, and a main reflector 7 which reflects electromagnetic waves which are reflected from the subreflector 6 and directs them at a target (not shown). The subreflector 6 is supported by a support mechanism 8 in a state in which it is separated from and axially aligned with the main reflector 7.

The reflector 1 is supported by a rotating support mechanism 9 so that it can rotate about the elevation axis 3 with respect to a rotating table 10, and it is rotated by the rotational drive source 11. A first rotary joint 13 is inserted into a power supply path 12 at a location on the elevation axis 3 so that the power supply path 12 which is connected to the radiator 5 does not interfere with the rotation of the reflector 1.

The reflector 1, which is supported so as to be able to rotate about the elevation axis 3 with respect to the rotating table 10, is also supported such that the rotating table 10 can rotate about the azimuth axis 2, so it can be rotated together with the rotating table 10 about the azimuth axis 2 by the rotational drive source 14. A second rotary joint 16 is provided in the power supply path 12 which connects a power supply apparatus 15 and the radiator 5 at a location on the center of rotation of the rotating table 10, i.e., on the azimuth axis 2 of the reflector 1, and this portion permits rotational movement of the rotating table 10 and the reflector 1 disposed on it about the azimuth axis 2.

The reflector 1 includes the main reflector 7 and the subreflector 6. Overall, it is an antenna having a substantially rectangular aperture having dimensions of a length D in the direction of the elevation axis 3 (see FIG. 1 and FIG. 2) and dimensions of a width W in the direction perpendicular to the elevation axis 3 (see FIG. 2 and FIG. 3). The elevation axis 3 passes through a location substantially at the center of the distance (the height) H in the direction of the azimuth axis 2 (the height direction) of the reflector 1 (see FIG. 1 and FIG. 3), and it has an axial center passing through a location at substantially the center of the direction (the width direction) W perpendicular to the elevation axis 3 of the reflector 1 (see FIG. 2 and FIG. 3).

Figure 3:
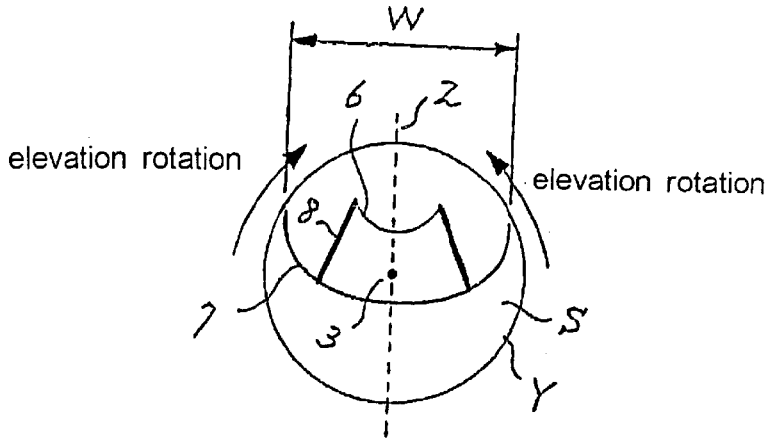
FIG. 3 is a schematic front view showing the reflector antenna apparatus of FIG. 1.

Accordingly, when the reflector 1 is rotated about the elevation axis 3, the range in which the reflector 1 moves, i.e., the operating region S is, as shown in FIG. 3, on the inside of a circle Y which is drawn on the extreme outer edge of the main reflector 7 and is centered on the elevation axis 3. The operating region S shown by this circle Y is extremely small compared to the antenna described in the previously-mentioned paper by Wakana, so the height of the antenna does not become large when the reflector rotates around the elevation axis.

The main reflector 7 and the subreflector 6 of the reflector 1 have undergone reflector surface adjustment so that substantially all of the electromagnetic waves which are provided to the reflector 1 are received and reflected. A concrete procedure for such reflector surface adjustment is known in this technical field and so will not be described in detail here. Reflector surface adjustment is a means for controlling the shape of the antenna aperture and the aperture distribution of the antenna and is described in detail in "IEE Proc. Microw. Antennas Propag.", Vol. 146, No. 1, pages 60–64, 1999, for example. Here, reflector surface adjustment is performed such that the shape of the aperture of the antenna is substantially rectangular and such that the aperture distribution is uniform.

This reflector antenna apparatus is a dual-reflector Cassegrain antenna in which electromagnetic waves which are irradiated by the primary radiator 5 are reflected by the subreflector 6, and the reflected electromagnetic waves are reflected by the main reflector 7 and irradiated towards an unillustrated target. The main reflector 7, the subreflector 6, the support mechanism 8 for the subreflector, the primary radiator 5, and a first portion 12*a* of the power supply path 12 can rotate about the center of the elevation rotational axis 3. The power supply path 12*a* is connected to a second portion 12*b* through the rotary joint 13, and power can be supplied to the primary radiator 5 even when the antenna rotates about the elevation axis 3.

In addition to the above-described structure which can rotate about the elevation axis 3, the rotary joint 13 and the second portion 12*b* of the power supply path 12 are secured atop the rotating table 10, and they can rotate about the azimuth axis 2 (in the azimuth direction). This antenna can freely scan about the two axes for the elevation and the azimuth, so the beam of the antenna can be directed in any desired direction. FIG. 2 is a view of this reflector antenna apparatus from above (from the direction of the reflector axis).

This reflector antenna apparatus is characterized in that the antenna is designed such that not only the antenna height H but also the size (the width) W in the direction perpendicular to the elevation axis 3 and perpendicular to the antenna reflector axis (azimuth axis 2) is small so that the antenna height does not become large when scanning is performed in the elevation direction. A summary of the design process for the reflector antenna apparatus is the following two steps.

First, an axially symmetric Cassegrain antenna is designed such that the antenna height H is D/4 so that the height is small when the antenna is not scanning. This condition is a condition such that when the subreflector 6 is a perfect hyperboloid and the main reflector 7 is a perfect paraboloid, the antenna height H including the main reflector 7 and the subreflector 6 is the minimum height for a given aperture diameter.

Next, in order to decrease the antenna height H during scanning about the elevation axis 3 (in the elevation direction), reflector surface adjustment is carried out such that the size (the width) W of the main reflector 7 in the direction perpendicular to both the azimuth axis 2 and the elevation axis 3 is small. Reflector surface adjustment is a means of controlling the shape of the antenna aperture and the aperture distribution of the antenna. It is described in the above-mentioned "IEE Proc. Microw. Antennas Propag.", Vol. 146, No. 1, pages 60–64, 1999, for example. By performing reflector surface adjustment, various shapes of the antenna aperture and aperture distributions can be realized.

FIG. 3 is a view from the elevation axis 3 of an antenna for which antenna design was carried out by the above-described means. In this figure, even if the antenna is rotated in the elevation direction, the antenna does not depart from within a fixed circle Y centered on the rotational axis 3, so a small antenna height can be realized. In addition, the aperture diameter D of the antenna can be adjusted to adjust the gain of the antenna and the beam width in the azimuth direction. In addition, the aperture distribution of the antenna can be controlled at the time of reflector surface adjustment to adjust the gain of the antenna, the beam width, and the like.

This antenna has a small antenna height even when it rotates about the elevation axis 3, so it has the effect that it can be used even in the case when there are restrictions on the place of installation of the antenna.

Embodiment 2

Figure 4:
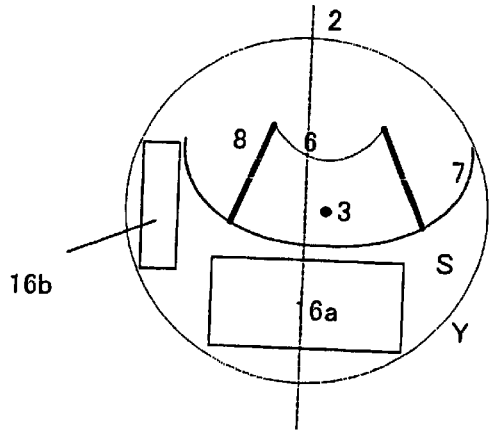
FIG. 4 is a schematic front view showing an array type reflector antenna apparatus of another embodiment of this invention.

The characteristics of a reflector antenna apparatus according to this invention are shown in FIG. 4. In FIG. 1, a power supply apparatus is installed below a rotary joint which rotates about the azimuth, but depending upon the antenna structure, a portion of the power supply circuit 16*a* and other portions 16*b* must be installed above the above-described rotary joint and must rotate in the azimuth and elevation directions at the same time as the main reflector. In this case, it is necessary to guarantee a space to be occupied by these parts. This is an antenna apparatus which previously takes into consideration this occupied space and in which the antenna height does not become large when the entire antenna apparatus including the main reflector rotates about the elevation axis.

This antenna apparatus has the effect that it can suppress the antenna height when it actually constitutes an antenna together with necessary parts.

Embodiment 3

Figure 5:
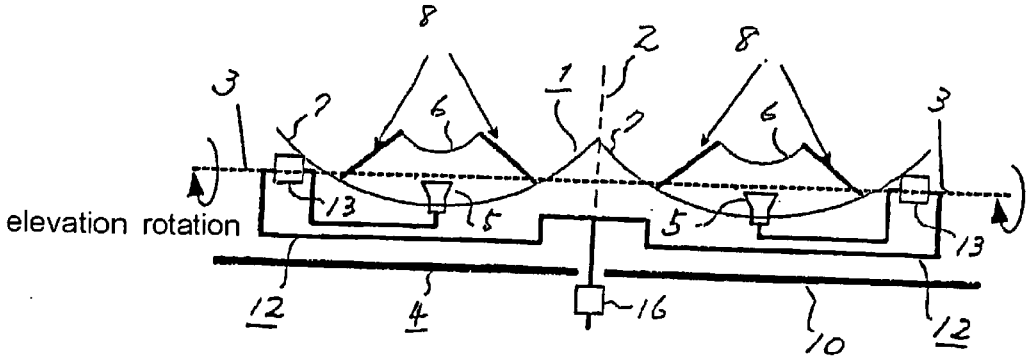
FIG. 5 is a schematic side view showing an array type reflector antenna apparatus of a third embodiment of this invention.
Figure 6:
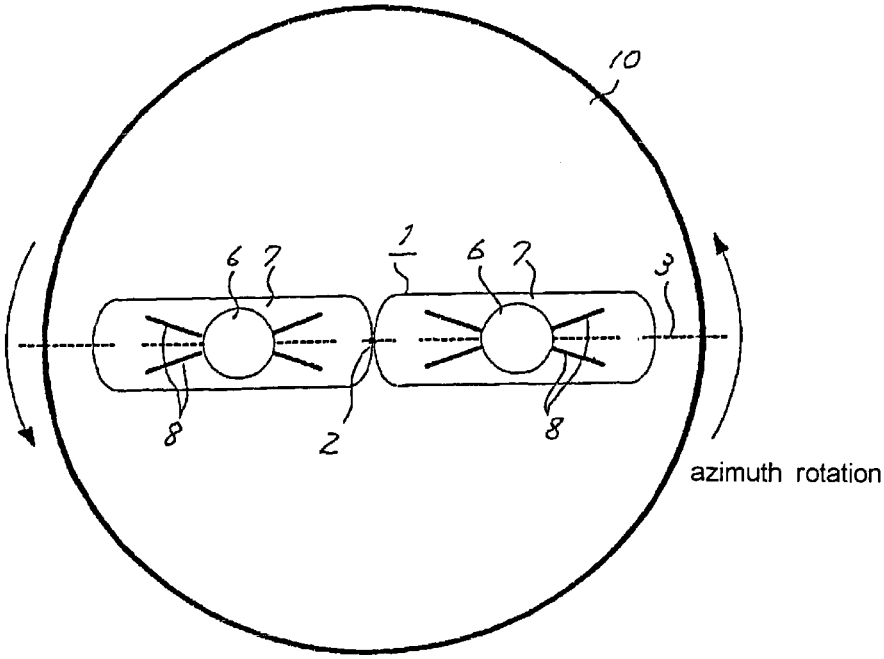
FIG. 6 is a schematic plan view showing the reflector antenna apparatus of FIG. 5.

A side view of another embodiment of a reflector antenna apparatus of this invention is shown in FIG. 5, and a plan view is shown in FIG. 6. In these views, the same or corresponding parts as in FIG. 1–FIG. 3 are affixed with the same symbols, so an explanation thereof will be abbreviated. Mentioning a portion thereof, 1 is a reflector, 7 is a main reflector, 6 is a subreflector, 8 is a support mechanism for the subreflector, 5 is a primary radiator, 12 is a current supply path, 2 is an azimuth axis, 3 is an elevation rotational axis, 13 and 16 are rotary joints, and 10 is a rotating table.

In this embodiment as well, an antenna can rotate about two axes, i.e., the azimuth axis 2 and the elevation axis 3, and its mechanism is the same as for the reflector antenna apparatus of the above-described embodiment. In this reflector antenna apparatus, instead of there being a single reflector (antenna), it is constituted by an array antenna using two antenna elements 1, i.e., two Cassegrain antennas. Rotation about the azimuth axis 2 is carried out not by rotating each antenna element 1, but by rotating the entire array of antenna elements 1 supported by the rotating table 10.

As stated with respect to the preceding embodiment, in an axially symmetric Cassegrain antenna, an antenna which is lowest in a state when the antenna is not scanning is ¼ of the antenna aperture diameter. Accordingly, an antenna having half the size in the direction of the elevation axis 3 of the antenna has half the height. By arranging two of these antennas in the direction of the elevation axis 3 to form an array antenna structure, the antenna height can be made less than half of the antenna height of the preceding embodiment.

In this embodiment, the antenna height can be made lower than in the previous embodiment, so it has the effect that it can be used even when the installation space of the reflector antenna apparatus is stricter with respect to dimensions.

Figure 7:
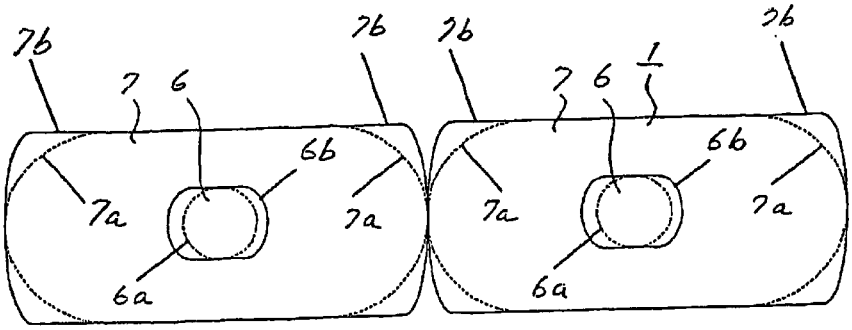
FIG. 7 is a schematic enlarged front view showing a reflector antenna of the reflector antenna apparatus of FIG. 5.

In this embodiment, an array antenna having two elements separated by several wavelengths is normally used, so grating lobes which are generated are suppressed. In order to suppress these grating lobes, reflector surface adjustment like that shown in FIG. 7 is carried out. In this figure, 7*a* is a main reflector prior to reflector surface adjustment, 6*a* is a subreflector prior to reflector surface adjustment, 7*b* is a main reflector after reflector surface adjustment, and 6*b* is a subreflector after reflector surface adjustment. First, reflector surface adjustment is carried out in which the aperture is made as rectangular as possible as viewed from the direction of the reflector axis. In addition, it is set so that the aperture distribution which is realized is a uniform distribution. Two antennas having a rectangular aperture with a uniform aperture distribution are equivalent to an antenna having one large aperture, so theoretically grating lobes are not generated.

In this embodiment, by carrying out suitable reflector surface adjustment, in an array antenna structure using two reflectors, undesirable grating lobes which are normally generated can be suppressed, and there is the effect that it can be suitably employed in cases having strict antenna specifications with respect to antenna height and side lobes and the like.

Embodiment 4

Figure 8:
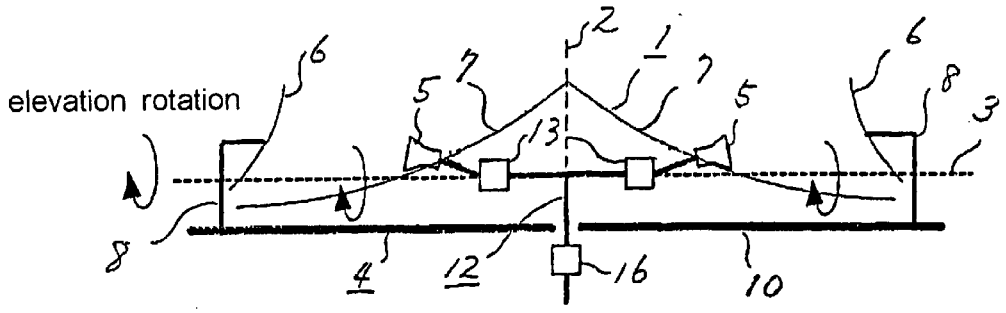
FIG. 8 is a schematic side view showing an array type reflector antenna apparatus of a fourth embodiment of this invention.
Figure 9:
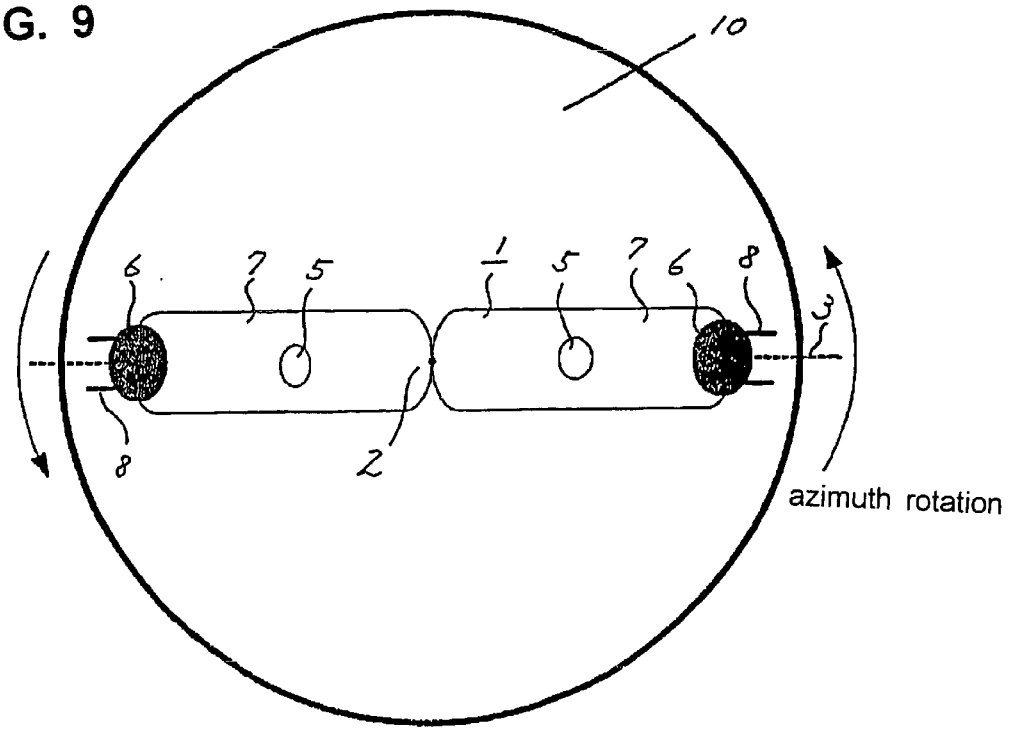
FIG. 9 is a schematic plan view showing the reflector antenna apparatus of FIG. 8.

A side view of a reflector antenna apparatus according to this invention is shown in FIG. 8, and a plan view is shown in FIG. 9. In these figures, 1 is a reflector, 7 is a main reflector, 6 is a subreflector, 8 is a support mechanism for the subreflector, 5 is a primary radiator, 12 is a power supply path, 3 is an elevation rotational axis, 13 and 16 are rotary joints, and 10 is a rotating table.

In this embodiment as well, the reflector 1 can rotate about two axes, i.e., an azimuth axis and an elevation axis, and the mechanism is the same as in the preceding embodiment. In contrast to the preceding embodiment, this embodiment has an array antenna structure using two offset Cassegrain antennas. In this embodiment, there are the effects that the effect of blocking by the subreflector can be made small, properties of the antenna such as the side lobe level can be improved, and it can be employed in situations having strict antenna specifications not only with respect to dimensional limitations but with respect to side lobes and the like.

Embodiment 5

Figure 10:
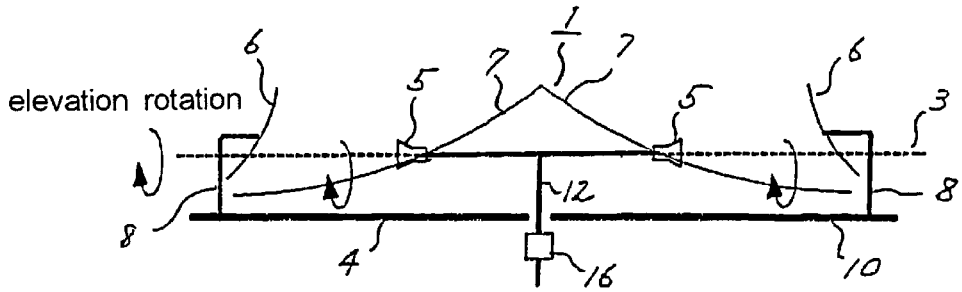
FIG. 10 is a schematic side view showing a reflector antenna of a reflector antenna apparatus of a fifth embodiment of this invention.

A side view of a reflector apparatus according to another embodiment of this invention is shown in FIG. 10. In this figure, the same or corresponding parts as shown in FIGS. 1–3 are affixed with the same symbols, so an explanation thereof will be abbreviated. Mentioning a portion thereof, 1 is a reflector, 7 is a main reflector, 6 is a subreflector, 8 is a support mechanism for the subreflector, 5 is a primary radiator, 12 is a power supply path, 2 is an azimuth axis, 3 is an elevation rotational axis, 16 is a rotary joint, and 10 is a rotating table.

In this embodiment, the reflector surface is designed such that the direction of the primary radiator 5 is parallel to the azimuth rotational surface. In this embodiment, the primary radiators 5 can be rotated with respect to the primary reflectors 7, so there is the effect that it becomes unnecessary to rotate the primary radiators 5 at the time of elevational rotation. In addition, the power supply path 12 for supplying power to the two primary radiators 5 can be connected without bending, so there is the effect that a simple structure can be employed. In addition, there is the effect that structural loads can be made small at the time of mechanical drive.

Embodiment 6

Figure 11:
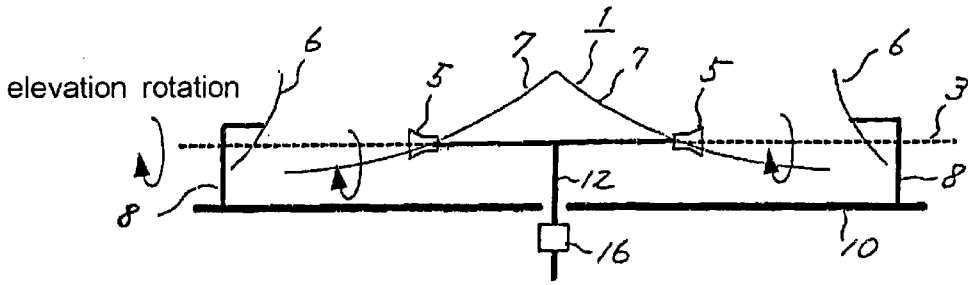
FIG. 11 is a schematic side view showing an array type reflector antenna apparatus of a sixth embodiment of this invention.
Figure 12:
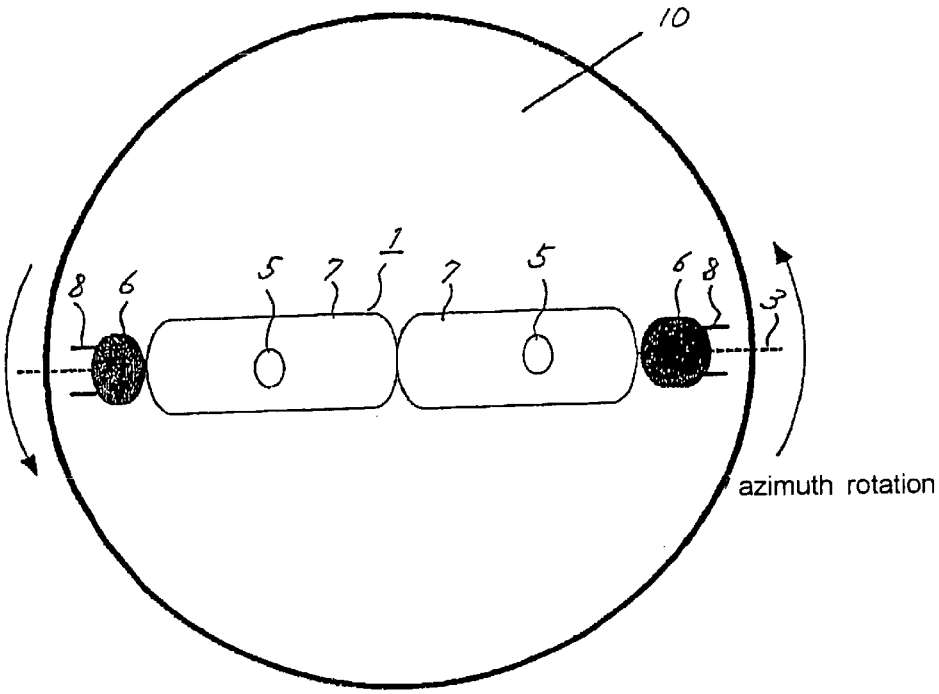
FIG. 12 is a schematic plan view showing the reflector antenna apparatus of FIG. 11.

A side view of a reflector antenna apparatus according to this invention is shown in FIG. 11, and a plan view is shown in FIG. 12. In these figures, the same or corresponding parts as shown in FIGS. 1–3 are affixed with the same symbols, so an explanation thereof will be abbreviated. Mentioning a portion thereof, 1 is a reflector, 7 is a main reflector, 6 is a subreflector, 8 is a support mechanism for the subreflector, 5 is a primary radiator, 12 is a power supply path, 2 is an azimuth axis, 3 is an elevation rotational axis, 16 is a rotary joint, and 10 is a rotating table.

The reflector antenna apparatus of this embodiment is fundamentally the same as the preceding embodiment, but the reflector surface is designed such that there is no blocking by the shadows from the subreflectors 6 when viewed from the direction of the azimuth axis 2 (the reflector axis). In this embodiment, the effect of blocking by the subreflectors 6 can be eliminated, so there is the effect that properties of the antenna such as the side lobe level can be improved.

Embodiment 7

Figure 13:
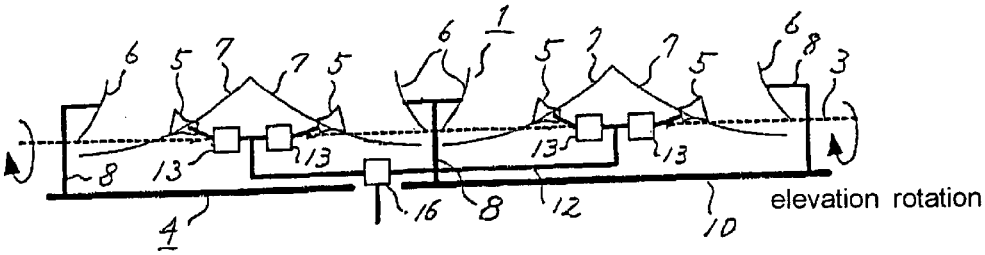
FIG. 13 is a schematic side view showing an array type reflector antenna apparatus of a seventh embodiment of this invention.
Figure 14:
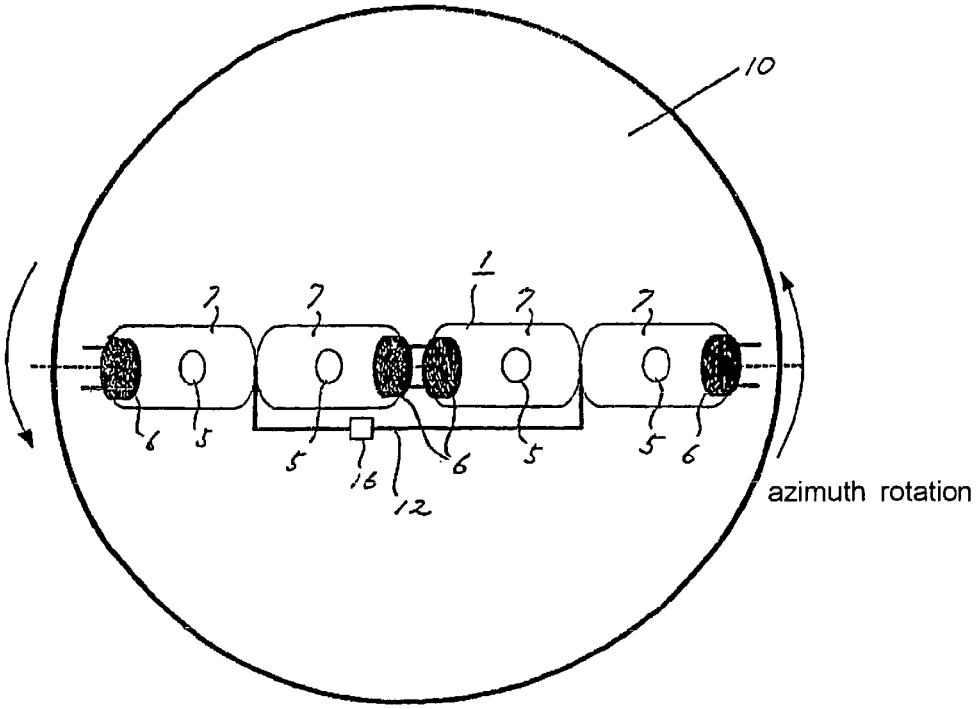
FIG. 14 is a schematic plan view showing the reflector antenna apparatus of FIG. 13.

A side view of a reflector antenna apparatus according to this invention is shown in FIG. 13, and a plan view is shown in FIG. 14. In these figures, the same or corresponding parts as shown in FIGS. 1–3 are affixed with the same symbols, so an explanation thereof will be abbreviated. Mentioning a portion thereof, 1 is a reflector, 7 is a main reflector, 6 is a subreflector, 8 is a support mechanism for the subreflector, 5 is a primary radiator, 12 is a power supply path, 2 is an azimuth axis, 3 is an elevation rotational axis, 13 and 16 are rotary joints, and 10 is a rotating table.

In Embodiments 4, 5, and 6, an array antenna structure is employed using two offset Cassegrain antennas as a reflector 1, but it is possible to have an array antenna using 3 or more offset Cassegrain antennas. FIG. 13 and FIG. 14 show an example of a reflector 1 having an array antenna structure using four offset Cassegrain antennas. In this embodiment, the aperture diameter of each offset Cassegrain antenna can be made small, so there is the effect that the antenna height of a reflector 1 of a reflector antenna apparatus which can be realized can be made smaller.

Embodiment 8

Figure 15:
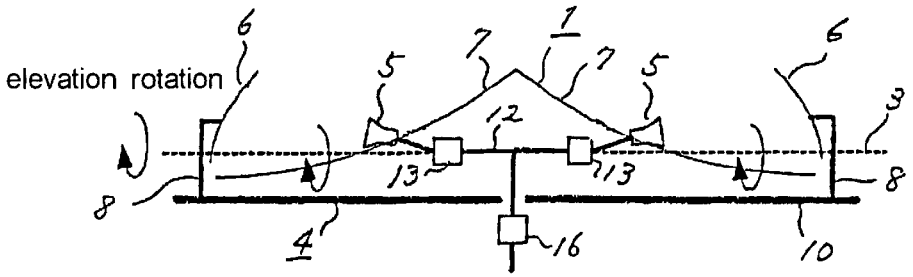
FIG. 15 is a schematic side view showing a reflector antenna apparatus of an eighth embodiment of this invention.

A side view of a reflector antenna apparatus according to yet another embodiment of this invention is shown in FIG. 15. In this figure, the same or corresponding parts as shown in FIGS. 1–3 are affixed with the same symbols, so an explanation thereof will be abbreviated. Mentioning a portion thereof, 1 is a reflector, 7 is a main reflector, 6 is a subreflector, 8 is a support mechanism for the subreflector, 5 is a primary radiator, 12 is a power supply path, 2 is an azimuth axis, 3 is an elevation rotational axis, 13 and 16 are rotary joints, and 10 is a rotating table.

In preceding Embodiments 2–7, an antenna structure was employed using one or a plurality of Cassegrain antennas as a reflector 1, but this embodiment is a reflector antenna apparatus applying Gregorian antennas to an antenna structure having the same overall structure. A reflector antenna apparatus applying Gregorian antennas to the reflector antenna apparatus of the above-described Embodiment 4 is shown in FIG. 15.

In this embodiment, the structure of the antenna is different, so it has the effect that depending upon the design, the antenna height can be decreased.

As described above, the effects of a reflector antenna apparatus according to the present invention are as follows.

(1) It is a reflector antenna apparatus having a reflector and a rotating mechanism which rotates the reflector about an azimuth axis and an elevation axis, in which the elevation axis passes through a location at substantially the center of the reflector in the direction of the azimuth axis and at substantially the center of the reflector in the direction perpendicular to the elevation axis, and the reflector has a substantially rectangular aperture which is elongated in the direction of the elevation axis, and the reflector has its reflector surface adjusted so as to receive and reflect substantially all of the supplied electromagnetic waves, whereby the antenna height does not become large when the reflector rotates about the elevation axis. Accordingly, a reflector antenna apparatus can be provided which can be installed within a small space, which has adequate practicality, and which can perform scanning by pivoting about two axes which are perpendicular to each other.

(2) It may be one in which the reflector has a subreflector which receives electromagnetic waves irradiated by the radiator and a main reflector which reflects electromagnetic waves which are reflected from the subreflector and directs them towards a target. Therefore, an efficient reflector antenna apparatus is possible which not only can be installed within a small space, but which has adequate practicality and which can perform scanning by pivoting about two axes which are perpendicular to each other.

(3) A portion of a current supply apparatus which rotates at the same time as the reflector antenna is included in the reflector so that the antenna height does not become large, so there is the effect that the height of the antenna can be restrained when the antenna apparatus is used to actually constitute an antenna including necessary parts.

(4) The reflector may be a reflector array having a plurality of reflector elements which are arranged in alignment with the elevation axis, so a reflector antenna apparatus can be provided which can decrease the antenna height, which can be installed within a small space, which has adequate practicality, and which can perform scanning by pivoting about two axes which are perpendicular to each other.

(5) It is one in which each of the reflector antennas of the main reflector has a substantially rectangular aperture, and reflector surface adjustment may be carried out so that when each reflector antenna is viewed in the direction of the reflector axis, the aperture is rectangular and the electromagnetic field distribution in the aperture is nearly uniform so as to suppress grating lobes. Accordingly, a reflector antenna apparatus can be provided in which the antenna height can be further decreased, which can be installed within a small space, which has adequate practicality, and which can perform scanning with higher efficiency by pivoting about two axes which are perpendicular to each other.

(6) It is one in which the reflector surface is set so that the radiator is parallel to the azimuth rotational surface, and the center of the central axis of the radiator is aligned with the elevation axis. Therefore, a reflector antenna apparatus can be provided which can be installed within a small space, which has adequate practicality, and which has a simple structure.

(7) It is one in which the reflector surface is set so that blocking by the subreflector does not occur as viewed from the reflector axis. Therefore, a reflector antenna apparatus can be provided which can be installed within a small space, which has adequate practicality, and in which blocking does not occur.

(8) The reflector antenna is a Cassegrain antenna, so a high efficiency reflector antenna apparatus can be provided which can be installed within a small space and which has adequate practicality.

(9) The reflector antenna is a Gregorian antenna, so a high efficiency reflector antenna apparatus can be provided which can be installed within a small space and which has adequate practicality.

Industrial Applicability

As described above, a reflector antenna apparatus according to the present invention is useful as a reflector antenna apparatus which can perform scanning by pivoting about two axes which are perpendicular with respect to each other.

What is claimed is:

1. A reflector antenna apparatus having a reflector and a rotating mechanism which rotates the reflector about an azimuth axis and an elevation axis, characterized in that the elevation axis passes through a location at substantially the center of the reflector in the direction of the azimuth axis and at substantially the center of the reflector in the direction perpendicular to the elevation axis, the reflector has a substantially rectangular aperture which is elongated in the direction of the elevation axis, and the reflector has its reflector surface adjusted so as to receive and reflect substantially all of the supplied electromagnetic waves, whereby the antenna height does not become large when the reflector rotates about the elevation axis.

2. A reflector antenna apparatus as claimed in claim 1 characterized by having a subreflector which receives electromagnetic waves irradiated by a radiator and a main reflector which reflects electromagnetic waves which are reflected from the subreflector and directs them towards a target.

3. A reflector antenna apparatus as claimed in claim 1 characterized in that the reflector includes a portion of a current supply apparatus which rotates at the same time as the reflector antenna so that the antenna height does not become large.

4. A reflector antenna apparatus as claimed in claim 1 characterized in that the reflector is a reflector array having a plurality of reflector elements which are arranged in alignment with the elevation axis.

5. A reflector antenna apparatus as claimed in claim 4 characterized in that each of the reflector antennas of the main reflector has a substantially rectangular aperture, and reflector surface adjustment is carried out so that when each reflector antenna is viewed in the direction of the reflector axis, the aperture is rectangular and the electromagnetic field distribution in the aperture is nearly uniform so as to suppress grating lobes.

6. A reflector antenna apparatus as claimed in claim 1 characterized in that the reflector surface is set so that the radiator is parallel to the azimuth rotational surface, and the center of the central axis of the radiator is aligned with the elevation axis.

7. A reflector antenna apparatus as claimed in claim 6 characterized in that the reflector surface is set so that blocking by the subreflector does not occur as viewed from the direction of the reflector axis.

8. A reflector antenna apparatus as claimed in claim 1 characterized in that the reflector antenna is a Cassegrain antenna.

9. A reflector antenna apparatus as claimed in claim 1 characterized in that the reflector antenna is a Gregorian antenna.

* * * * *